US005307792A

United States Patent [19]

Takahashi et al.

[11] Patent Number: 5,307,792

[45] Date of Patent: May 3, 1994

[54] TWO CYCLE ENGINE PROVIDED WITH A SCAVENGING PUMP

[75] Inventors: Masanori Takahashi; Masahiko Katoh, both of Hamamatsu, Japan

[73] Assignee: Sanshin Kogyo Kabushiki Kaisha, Hamamatsu, Japan

[21] Appl. No.: 871,902

[22] Filed: Apr. 21, 1992

[30] Foreign Application Priority Data

Apr. 22, 1991 [JP] Japan ..... 3-116594

[51] Int. Cl.[5] ..... F02B 75/02

[52] U.S. Cl. ..... 123/65 A; 123/65 BA

[58] Field of Search ..... 123/65 P, 65 BA, 65 A

[56] References Cited

U.S. PATENT DOCUMENTS

| | | | |
|---|---|---|---|
| 1,978,816 | 10/1934 | Pollister | 123/65 P |
| 2,635,593 | 4/1953 | Stoll | 123/65 A |
| 4,236,490 | 12/1980 | Correll | 123/65 A |
| 4,321,893 | 3/1982 | Yamamoto | 123/65 A |
| 4,899,698 | 2/1990 | Thery | 123/65 A |
| 4,919,088 | 4/1990 | Krieger et al. | 123/65 A |
| 5,072,699 | 12/1991 | Pien | 123/65 P |

FOREIGN PATENT DOCUMENTS

| | | | |
|---|---|---|---|
| 0000517 | 1/1981 | Japan | 123/65 P |
| 0170423 | 9/1984 | Japan | 123/65 P |
| 2-76126 | 6/1990 | Japan . | |

*Primary Examiner*—Noah P. Kamen

*Attorney, Agent, or Firm*—Knobbe, Martens, Olson & Bear

[57] ABSTRACT

A scavenge system for a two cycle internal combustion engine that includes separate scavenge manifolds and riser scavenge passages extending therefrom to the individual scavenge ports so as to permit the establishment of a desired flow pattern within the engine without the flow to one scavenge port interfering with the flow to the other scavenge ports.

34 Claims, 3 Drawing Sheets

TWO CYCLE ENGINE PROVIDED WITH A SCAVENGING PUMP

BACKGROUND OF THE INVENTION

This invention relates to two cycle engine provided with a scavenging pump and more particularly to an improved scavenging system for a two cycle engine.

It has been the practice to provide multiple scavenging ports for a two cycle engine in order to achieve better scavenging and to control the flow pattern within the combustion chamber and cylinder during the scavenging operation. For example, it is quite common to use a center and a pair of side scavenging ports that have an upward inclination so as to direct a charge entering the chamber in an upward direction toward the cylinder head to establish a loop type of scavenging action in the combustion chamber. It should be readily apparent that it is desirable to provide good scavenging of the exhaust gases and, at the same time, avoid the escape of any fresh air and fuel charge from the combustion chamber out of the exhaust port.

A disadvantage with the type of scavenging systems previously proposed is that a single scavenge manifold encircles or partially encircles the cylinder and each of the scavenge ports are fed from this scavenge manifold through respective riser portions. As a result, there is a different flow resistance from the scavenge air inlet to the various scavenge ports and the scavenge ports most remotely positioned from the inlet may not receive the desired amount of air flow. Alternatively, the more closely positioned scavenge ports may receive a greater than desired air flow.

It is, therefore, a principal object of this invention to provide an improved scavenging system for a two cycle engine wherein a plurality of scavenge ports may each be provided with the desired air flow without the flow to one scavenge port adversely affecting the flow to the other scavenge ports.

It is a further object of this invention to provide an improved scavenge port and manifolding system for a two cycle engine.

It is a further object of this invention to provide a scavenge porting and supply arrangement for a two cycle engine that permits the achievement of the desired scavenging pattern in the combustion chamber.

SUMMARY OF THE INVENTION

This invention is adapted to be embodied in a scavenging system for a two cycle internal combustion engine that is comprised of a cylinder having a bore in which a piston reciprocates. A first scavenging port is formed in the cylinder for admitting a charge to the bore. A second scavenging port is also provided in the cylinder for admitting a charge to the bore and is spaced from the first scavenging port. First and second manifold sections are provided, each of which serves a respective one of the first and second scavenge ports through respective scavenge passages. A source of air under pressure communicates with the first and second manifold sections.

DETAILED DESCRIPTION OF THE PREFERRED EMBODIMENTS OF THE INVENTION

Figure 1:
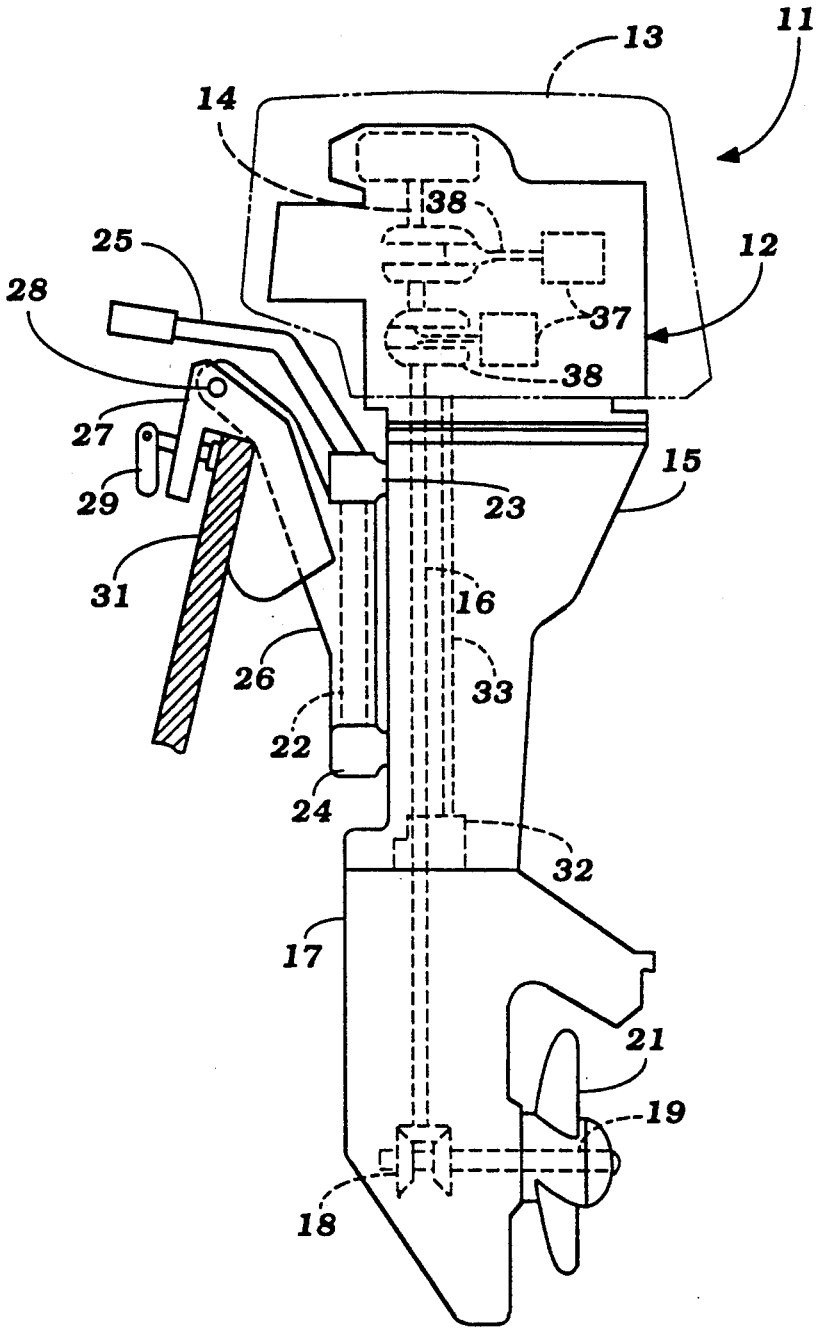
FIG. 1 is a side elevational view of an outboard motor constructed in accordance with an embodiment of this invention.

Referring first to FIG. 1, an outboard motor having an internal combustion engine constructed in accordance with an embodiment of the invention is identified generally by the reference numeral 11. The invention is described in conjunction with an outboard motor because the invention has utility in two cycle internal combustion engines and such engines are normally employed as the power plant in outboard motors. The engine, which is indicated by the reference numeral 12, forms a portion of the power head of the outboard motor 11 and is enclosed by a protective cowling, shown in phantom and identified generally by the reference numeral 13. In the illustrated embodiment, the engine 12 is of the two cylinder in-line type. It is to be understood, however, that the invention may be employed with other cylinder numbers or configurations and those skilled in the art will readily understand how the invention can be employed in conjunction with other cylinder configurations and numbers.

The engine 12, as is typical with outboard motor practice, is disposed so that the cylinders extend horizontally and a crankshaft, indicated by the reference numeral 14, rotates about a vertically extending axis.

A driveshaft housing 15 depends from the afore described power head and rotatably journals a driveshaft 16 that is coupled in a known manner to the crankshaft 14. The driveshaft 16 depends into a lower unit 17 and therein drives a conventional forward/neutral/reverse transmission 18 for driving a propeller shaft 19 and propeller 21 in a well known manner.

A steering shaft 22 is affixed to the driveshaft housing 15 by upper and lower brackets 23 and 24. This steering shaft 22 has a tiller 25 affixed to its upper end and is journaled within a swivel bracket 26 for steering of the outboard motor 11 about a generally vertically extending steering axis, as is well known in this art.

The swivel bracket 26 is connected to a clamping bracket 27 by means of a pivot pin 28 which is generally horizontally disposed so as to allow tilt and trim of the outboard motor 11 as is well known in this art. A clamping device 29 is carried by the clamping bracket 27 for affixing the outboard motor 11 to a transom 31 of an associated watercraft.

The engine 12 is water cooled and, as is typical in outboard motor practice, a water pump 32 is carried within the driveshaft housing 15 at the interface with the lower unit 17. The water pump 32 is driven by the driveshaft 16 in a known manner and supplies cooling water which has been drawn from the body of water in which the outboard motor 11 is operating and delivers it to the engine cooling jacket through a supply conduit 33.

It should be understood that the foregoing description of the outboard motor 11 is purely to illustrate a specific application for the embodiments of the invention and for that reason, further details of the construction of the outboard motor are not necessary to understand and practice the invention.

The invention relates primarily to the scavenging system for the engine 12 and this will now be described initially by particular reference to FIG. 2. In this figure, only a cross section taken through a single cylinder of the engine 12 is depicted as it is believed readily apparent to those skilled in the art how the invention may be practiced in conjunction with multiple cylinder engines.

The engine 12 includes a cylinder block 34 in which a pair of parallel cylinder bores 35 are formed by liners 36 that are cast or pressed into openings in the cylinder block 34. Pistons 37 reciprocate in each of the cylinder bores 35 and are connected by means of respective connecting rods 38 to the throws 39 of the crankshaft 14. The crankshaft 14 is rotatably journaled within a crankcase chamber 41 that is formed by a skirt 42 of the cylinder block 34 and a crankcase member 43 that is affixed to the cylinder block 34 in any known manner.

A cylinder head assembly 44 is affixed to the cylinder block 34 in a known manner and has a pair of recesses 45 which cooperate with the cylinder bores 35 and pistons 37 to form the individual combustion chambers of the engine. As will be hereinafter noted, the recesses 45 are offset to one side of the cylinder bore 35 to improve scavenging. Spark plugs 46 are mounted in the cylinder head 44 and associated with each of the recesses 45 for firing the charge therein. A suitable ignition system (not shown) fires the spark plugs 46.

The engine 12 is provided with a scavenging system which includes a scavenge pump, indicated generally by the reference numeral 47. In the illustrated embodiment, the scavenge pump 47 is of the positive displacement Roots type having a pair of intermeshing rotors 48 that are driven by the crankshaft 14 in a suitable manner. Atmospheric air is drawn into the scavenge pump 47 through an air inlet 49 in which a throttle valve 51 is positioned. The throttle valve 51 is controlled by the operator so as to control the speed of the engine 12 as is well known.

A by-pass passage 52 in which a valve 53 is incorporated limits the maximum boost pressure generated by the scavenge pump 47.

Figure 2:
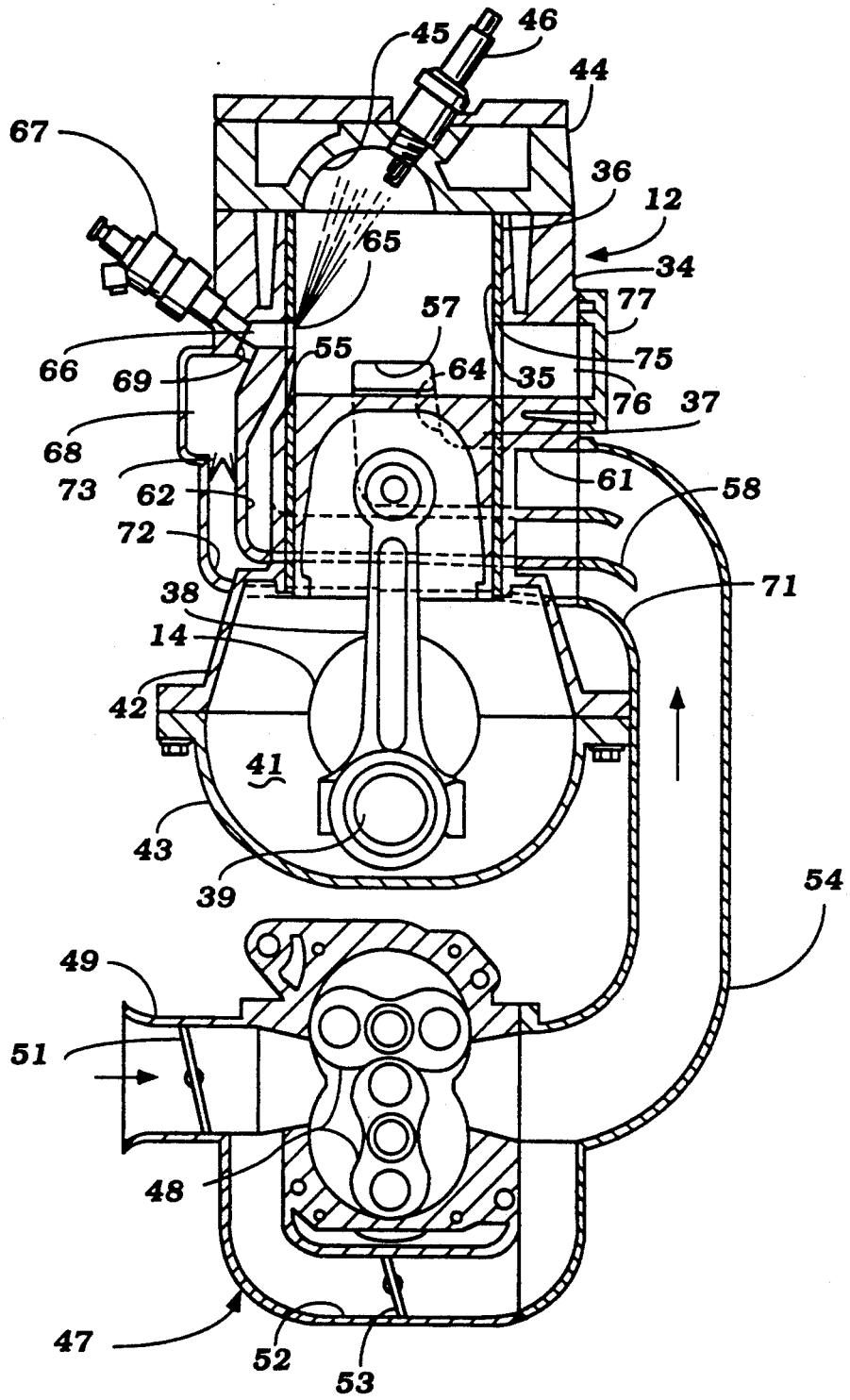
FIG. 2 is an enlarged cross-sectional view taken through a single cylinder of the outboard motor.
Figure 3:
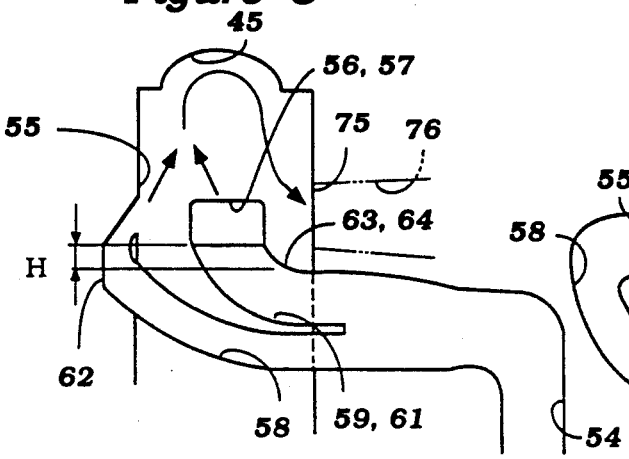
FIG. 3 is a partially schematic side elevational view showing the scavenging system in accordance with a first embodiment of the invention.
Figure 4:
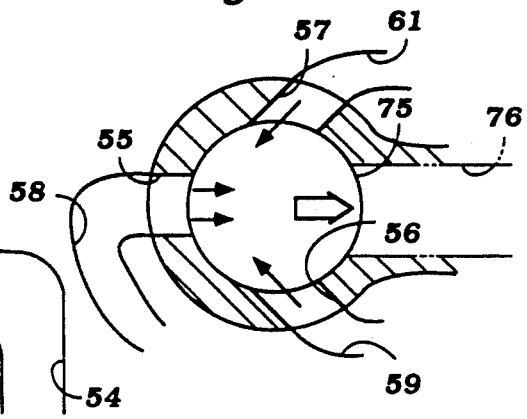
FIG. 4 is a cross-sectional view taken through the embodiment of FIG. 3.

The scavenge pump 47 discharges into an intake manifold 54 that cooperates with a scavenge system, to be described, for supplying, in this embodiment, three scavenge ports including a center scavenge port 55 and a pair of side scavenge ports 56 and 57 (see FIGS. 3 and 4 in addition to FIG. 2). In the past, it has been the practice to supply each of the scavenge ports 55, 56 and 57 from a common scavenge manifold that extended at least partially around the cylinder bore 35 in the cylinder block 34. However, such an arrangement does not provide equal air flow to each of the scavenge ports 55, 56 and 57 or, alternatively, does not permit the desired flow relationships between the scavenge ports 55, 56 and 57 to permit the achievement of the desired scavenging action within the cylinder bore 35.

Therefore, and in accordance with the invention, each scavenge port 55, 56 and 57 is supplied with air from the scavenge pump 47 through a respective scavenge manifold, such manifolds being indicated by the reference numerals 58, 59 and 61, respectively. As may be seen best in FIGS. 3 and 4, these manifolds 58, 59 and 61, extend generally parallel to each other but are separated from each other. At their inlet ends, the scavenge manifolds 58, 59 and 61 all communicate with the intake manifold 54 and have respective inlet openings to it. Because the inlet ends of the scavenge manifolds 58, 59 and 61 all communicate adjacent each other with the intake manifold 54, there will be a decrease in the interference of pressure between the respective scavenge manifolds 58, 59 and 61.

Individual riser sections 62, 63 and 64 each serve the scavenge ports 55, 56 and 57 from the scavenge manifolds 58, 59 and 61. As may be seen in FIG. 3, the height H of the risers 63 and 64 above their respective manifolds 59 and 61 is indicated. The height of the riser 62 is greater than that of the risers 63 and 64 as may be clearly seen in FIG. 3. Because each scavenge port 55, 56 and 57 is supplied by its own manifold and riser, each manifold and riser may be configured and sized so as to provide the desired air flow from that respective scavenge port 55, 56 or 57 without adversely affecting the flow pattern from the other scavenge ports.

The engine 12 is provided with a fuel/air injection system of the type described in our co-pending application entitled, "Fuel Injection System for Two Cycle Engine," Ser. No. 831,786 filed Feb. 5, 1992. For that reason, reference may be had to our co-pending application for the advantages of the fuel/air injection system and variants which may be practiced in conjunction with it. However, the basic structure of the fuel/air injection system will be described now.

The fuel/air injection system is comprised of a relatively small nozzle port 65 that is formed in the wall of the cylinder liner 36 immediately above the center scavenge port 55. A chamber 66 is formed in the cylinder block 34 in communication with the nozzle port 65 and fuel is injected into this chamber by an electrically controlled fuel injector 67 of a known type.

Air under pressure from the scavenge pump 47 is delivered, in a manner to be described, to a pressure chamber 68 which is also formed in the cylinder block 34 and which communicates with the chamber 66 through a restricted opening 69. An air pressure manifold 71 also communicates with the intake manifold 54 independently of the scavenge manifolds 58, 59 and 61 and supplies the chamber 68 through a riser 72. A check valve 73 is provided at the upper end of the rise 72 so that air pressure cannot escape back from the chamber 68 into the manifold 71.

The injection system operates by having the nozzle port 65 opened and closed by the reciprocation of the piston 37. When the piston 37 first opens the nozzle port 65, an air charge will be delivered which will assist in the scavenging action. Depending upon the load and speed, at some time during the period when the nozzle port 65 is opened, fuel will be injected by the injector 67 into the chamber 66 and this fuel will be mixed with the air therein and discharged at a high velocity upwardly toward the cylinder head recess 45. It should be noted that the cylinder head recess 45 is offset toward the side of the cylinder bore 35 where the center scavenge port 55 is positioned.

At an appropriate time the spark plug 46 will be fired and the gases in the combustion chamber will then burn and expand to drive the piston 37 downwardly. Eventually, an exhaust port 75 formed diametrically opposite the scavenge port 55 will be opened and the exhaust gases can flow through the exhaust port 75 into an exhaust manifold 76 formed in the cylinder block 34 and closed by a cover plate 77. These exhaust gases then flow downwardly and are discharged through an exhaust system (not shown) contained within the driveshaft housing 15 and lower unit 17, as is well known in the outboard motor art.

As may be seen in FIGS. 3 and 4, the side scavenge ports 56 and 57 and their riser sections 63 and 64 are inclined so as to direct the charge toward the cylinder head 44, away from the exhaust port 77 and toward the recess 45. In this way, good scavenging will be achieved without having any of the fuel injected by the injector 67 being swept out of the exhaust port 77.

Figure 5:
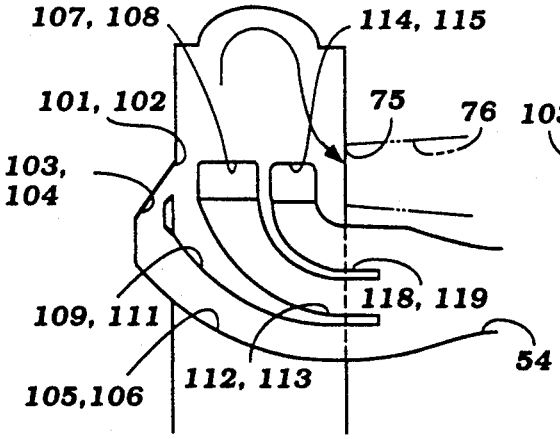
FIG. 5 is a partially schematic side elevational view, in part similar to FIG. 3, and shows a further embodiment of the invention.
Figure 6:
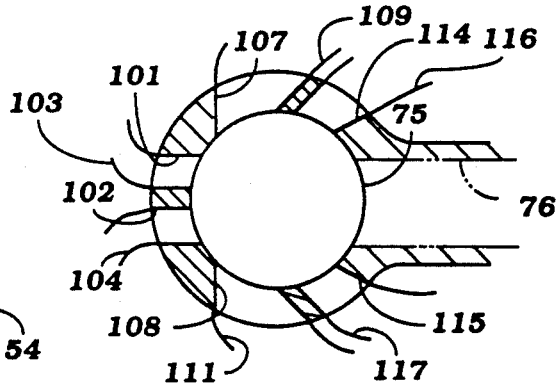
FIG. 6 is a cross sectional view taken through the embodiment of FIG. 5 and is in part similar to FIG. 4.

In the embodiment of the invention as thus far described, the engine 12 has been provided with three scavenge ports 55, 56 and 57. However, the invention may be practiced in conjunction with various other numbers of scavenge ports, scavenge manifold sections and risers. FIGS. 5 and 6 show another embodiment, which is generally similar to the embodiment of FIGS. 2–4, but in this embodiment a different number of scavenge ports are employed. In this embodiment, there are provided a pair of center scavenge ports 101 and 102, each of which is supplied by a respective riser section 103 and 104 from a respective scavenge manifold 105, 106. There are also provided a pair of first side scavenge ports 107 and 108 which are closer to the scavenge ports 101 and 102 and which are supplied by respective risers 109 and 111 from individual scavenge manifolds 112 and 113.

A further pair of side scavenge ports 114 and 115 are disposed closer to the exhaust port 75 and are supplied by respective risers 116 and 117 from respective scavenge manifolds 118 and 119. All of the scavenge manifolds 105, 106, 112, 113, 118 and 119 receive air from the intake manifold 54 under pressure. Like the previously described embodiment, since the scavenge manifolds 105, 106, 112, 113, 118 and 119 all communicate independently with the common intake manifold 51 there will be a decrease in the interference of pressure between the respective scavenge manifolds.

It should be readily apparent from the foregoing description that the described embodiments of the invention are effective in providing any type of desired scavenge pattern within a two cycle internal combustion engine because of the fact that each scavenge port is supplied by its own individual riser and scavenge manifold. Of course, the foregoing description is that of preferred embodiments of the invention and various changes and modifications may be made without departing from the spirit and scope of the invention, as defined by the appended claims.

We claim:

1. A scavenge system for a two cycle internal combustion engine comprising a cylinder having a bore in which a piston reciprocates, a first scavenge port formed in said cylinder for admitting a charge into said bore, a second scavenge port formed in said cylinder for admitting a charge into said bore, a first scavenge manifold extending at least in part around said cylinder bore, a second scavenge manifold extending at least in part around said cylinder bore, a first scavenge riser passage extending from said first scavenge manifold to only said first scavenge port, a second riser scavenge passage extending from said second scavenge manifold to only said second scavenge port, and a source of air communicating with said first and said second scavenge manifolds.

2. A scavenge system for a two cycle internal combustion engine as set forth in claim 1 wherein the first and second manifolds have common air inlet portions communicating with the source of air.

3. A scavenge system for a two cycle internal combustion engine as set forth in claim 2 further including a third scavenge port, a third scavenge manifold, and a third scavenge riser passage extending from said third manifold only to said third scavenge port, said third scavenge manifold also communicating with said source of air.

4. A scavenge system for a two cycle internal combustion engine as set forth in claim 3 wherein the scavenge ports are circumferentially spaced relative to each other.

5. A scavenge system for a two cycle internal combustion engine as set forth in claim 2 further including a cylinder head affixed to the cylinder and having a recess offset to one side thereof adjacent the scavenge ports.

6. A scavenge system for a two cycle internal combustion engine as set forth in claim 5 further including a third scavenge port, a third scavenge manifold, and a third scavenge riser passage extending from said third manifold only to said third scavenge port, said third scavenge manifold also communicating with said source of air.

7. A scavenge system for a two cycle internal combustion engine as set forth in claim 6 wherein the scavenge ports are circumferentially spaced relative to each other.

8. A scavenge system for a two cycle internal combustion engine as set forth in claim 1 further including a scavenge pump for providing air under pressure to the manifold sections.

9. A scavenge system for a two cycle internal combustion engine as set forth in claim 8 wherein the first and second manifolds have common air inlet portions communicating with the source of air under pressure.

10. A scavenge system for a two cycle internal combustion engine as set forth in claim 9 further including a third scavenge port, a third scavenge manifold, and a third scavenge riser passage extending from said third manifold only to said third scavenge port, said third scavenge manifold also communicating with said source of air under pressure.

11. A scavenge system for a two cycle internal combustion engine as set forth in claim 10 wherein the scavenge ports are circumferentially spaced relative to each other.

12. A scavenge system for a two cycle internal combustion engine as set forth in claim 9 further including a cylinder head affixed to the cylinder and having a recess offset to one side thereof adjacent the scavenge ports.

13. A scavenge system for a two cycle internal combustion engine as set forth in claim 12 further including a third scavenge port, a third scavenge manifold, and a third scavenge riser passage extending from said third manifold only to said third scavenge port, said third scavenge manifold also communicating with said source of air under pressure.

14. A scavenge system for a two cycle internal combustion engine as set forth in claim 13 wherein the scavenge ports are circumferentially spaced relative to each other.

15. A scavenge system for a two cycle internal combustion engine as set forth in claim 1 wherein the source of air comprises a common intake manifold into which each of the scavenge passages open in adjacent relationship to each other.

16. A scavenge system for a two cycle internal combustion engine as set forth in claim 15 further including a third scavenge port, a third scavenge manifold, and a third scavenge riser passage extending from said third manifold only to said third scavenge port, said third scavenge manifold also communicating with said source of air.

17. A scavenge system for a two cycle internal combustion engine as set forth in claim 16 wherein the scavenge ports are circumferentially spaced relative to each other.

18. A scavenge system for a two cycle internal combustion engine as set forth in claim 15 further including a scavenge pump for supplying air under pressure to the intake manifold.

19. A scavenge system for a two cycle internal combustion engine as set forth in claim 18 further including a third scavenge port, a third scavenge manifold, and a third scavenge riser passage extending from said third manifold only to said third scavenge port, said third scavenge manifold also communicating with said source of air.

20. A scavenge system for a two cycle internal combustion engine as set forth in claim 19 wherein the scavenge ports are circumferentially spaced relative to each other.

21. A scavenge system for a two cycle internal combustion engine comprising a cylinder having a bore in which a piston reciprocates, a first scavenge port formed in said cylinder for admitting a charge into said bore, a second scavenge port formed in said cylinder for admitting a charge into said bore, a third scavenge port formed in said cylinder for admitting a charge into said bore, a first scavenge manifold, a second scavenge manifold, a third scavenge manifold, a first scavenge riser passage extending from said first scavenge manifold to said first scavenge port, a second rise scavenge passage extending from said second scavenge manifold to said second scavenge port, a third scavenge riser passage extending form said third manifold to said third scavenge port, and a source of air communicating with said first, second and third scavenge manifolds.

22. A scavenge system for a two cycle internal combustion engine as set forth in claim 21 wherein the first, second and third manifolds have common air inlet portions communicating with the source of air.

23. A scavenge system for a two cycle internal combustion engine as set forth in claim 22 further including a cylinder head affixed to the cylinder and having a recess offset to one side thereof adjacent the scavenge ports.

24. A scavenge system for a two cycle internal combustion engine as set forth in claim 23 wherein the scavenge ports are circumferentially spaced relative to each other.

25. A scavenge system for a two cycle internal combustion engine as set forth in claim 21 wherein the scavenge ports are circumferentially spaced relative to each other.

26. A scavenge system for a two cycle internal combustion engine as set forth in claim 21 further including a scavenge pump for providing air under pressure to the manifold sections.

27. A scavenge system for a two cycle internal combustion engine as set forth in claim 26 wherein the first, second and third scavenge manifolds have common air inlet portions communicating with the source of air under pressure.

28. A scavenge system for a two cycle internal combustion engine as set forth in claim 27 wherein the scavenge ports are circumferentially spaced relative to each other.

29. A scavenge system for a two cycle internal combustion engine as set forth in claim 27 further including a cylinder head affixed to the cylinder and having a recess offset to one side thereof adjacent the scavenge ports.

30. A scavenge system for a two cycle internal combustion engine as set forth in claim 29 wherein the scavenge ports are circumferentially spaced relative to each other.

31. A scavenge system for a two cycle internal combustion engine as set forth in claim 21 wherein the source of air comprises a common intake manifold into which each of the scavenge passages open in adjacent relationship to each other.

32. A scavenge system for a two cycle internal combustion engine as set forth in claim 31 wherein the scavenge ports are circumferentially spaced relative to each other.

33. A scavenge system for a two cycle internal combustion engine as set forth in claim 31 further including a scavenge pump for supplying air under pressure to the intake manifold.

34. A scavenge system for a two cycle internal combustion engine as set forth in claim 33 wherein the scavenge ports are circumferentially spaced relative to each other.

* * * * *